US010655508B1

(12) United States Patent
Patel

(10) Patent No.: US 10,655,508 B1
(45) Date of Patent: May 19, 2020

(54) VALVE BODY ASSEMBLY FOR IDLER SHAFT MOUNTED CAMSHAFT PHASING SYSTEM

(71) Applicant: Schaeffler Technologies AG & Co. KG, Herzogenaurach (DE)

(72) Inventor: Dipan Patel, Livonia, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 16/239,975

(22) Filed: Jan. 4, 2019

(51) Int. Cl.
*F01L 1/344* (2006.01)
*F01L 1/02* (2006.01)
*F01L 1/047* (2006.01)

(52) U.S. Cl.
CPC ..... *F01L 1/3442* (2013.01); *F01L 1/026* (2013.01); *F01L 1/047* (2013.01); *F01L 2001/3443* (2013.01); *F01L 2001/3445* (2013.01); *F01L 2001/34433* (2013.01); *F01L 2001/34486* (2013.01)

(58) Field of Classification Search
CPC ... F01L 2001/34423; F01L 2001/34426; F01L 2001/3443; F01L 2001/34433; F01L 2001/3445; F01L 2001/34479; F01L 2001/34486; F01L 1/46; F01L 2250/06; F01L 2800/17
USPC ..... 123/90.15, 90.31
See application file for complete search history.

(56) References Cited

U.S. PATENT DOCUMENTS

| | | | | |
|---|---|---|---|---|
| 3,331,256 | A | 7/1967 | Morris | |
| 6,308,672 | B1 * | 10/2001 | Lichti | F01L 1/34 123/90.17 |
| 6,332,441 | B1 * | 12/2001 | Sugiyama | F01L 1/02 123/195 C |
| 7,305,948 | B2 | 12/2007 | Heintzen et al. | |
| 2008/0060595 | A1 * | 3/2008 | Yoshijima | F01L 1/344 123/90.16 |
| 2009/0260589 | A1 | 10/2009 | Ottersbach et al. | |
| 2011/0180963 | A1 * | 7/2011 | Kuno | B29C 45/14065 264/279 |
| 2012/0111295 | A1 | 5/2012 | Plate et al. | |
| 2014/0102392 | A1 | 4/2014 | Busse | |
| 2015/0128889 | A1 * | 5/2015 | Konishi | F01L 1/3442 123/90.15 |
| 2016/0032790 | A1 | 2/2016 | David et al. | |

(Continued)

*Primary Examiner* — Jorge L Leon, Jr.
(74) *Attorney, Agent, or Firm* — Volpe and Koenig, P.C.

(57) ABSTRACT

A variable camshaft timing system for an internal combustion engine with an idler shaft mounted camshaft phaser is provided. The camshaft phaser includes a driven wheel that is driven by the crankshaft, a driving wheel that drives the camshaft, and a hydraulically driven phasing assembly therebetween. A valve body is connected to the idler shaft for directing the flow of pressurized hydraulic medium to the camshaft phaser. The valve body includes a center part with an integral retainer for holding the camshaft phaser on the idler shaft, and a radial extension integrally connected to the center part that extends radially outwardly from an axis of the idler shaft a predefined distance. A control valve receiving part is integrally connected to radial extension and includes a control valve bore. A control valve is located in the control valve bore in the valve body. The control valve extends through the engine cover at a desired location for control valve maintenance.

14 Claims, 7 Drawing Sheets

(56) References Cited

U.S. PATENT DOCUMENTS

| | | | | |
|---|---|---|---|---|
| 2017/0037747 | A1* | 2/2017 | Yokoyama | F01L 1/3442 |
| 2018/0080352 | A1 | 3/2018 | Patel | |

* cited by examiner

VALVE BODY ASSEMBLY FOR IDLER SHAFT MOUNTED CAMSHAFT PHASING SYSTEM

FIELD OF INVENTION

This application is generally related to a variable camshaft phaser, and is more particularly related to a valve body arrangement for the control valve for hydraulic fluid used to actuate the variable camshaft phaser.

BACKGROUND

U.S. Pat. No. 7,305,948 B2 discloses a cam phasing system for a double overhead camshaft (DOHC) configuration.

U.S. Pub. 2016/0032790 A1 describes an accessible solenoid valve; however, the spool valve portion is not accessible and the valve body assembly mounts to the engine itself.

U.S. Pub. 2018/0080352, which is by the present inventor and is incorporated herein by reference as if fully set forth, describes a camshaft phaser that is installed on an idler shaft in the drive line between the crankshaft and the camshaft of an internal combustion engine. Here, the control valve is mounted to the front of the idler shaft.

It would be desirable to provide for simplified mounting of a camshaft phaser as well as more flexibility in positioning of the control valve for ease of maintenance as well as to minimize required changes to other engine components and accessories mounted in a front area of an engine.

SUMMARY

To address the issues noted above, a variable camshaft timing system for an internal combustion engine is provided. The system includes an idler shaft with a bearing journal, and a camshaft phaser rotatably mounted on the bearing journal. The camshaft phaser includes a driving wheel that drives the camshaft, a driven wheel that is driven by the crankshaft, and a hydraulically driven phasing assembly configured for varying a relative phase of the driving wheel with respect to the driven wheel. First and second pressurized hydraulic medium lines are connected to the hydraulically driven phasing assembly. A valve body is connected to the idler shaft for directing the flow of pressurized hydraulic medium to the first and second pressurized hydraulic medium lines from a control valve mounted to the valve body. The valve body includes a center part with an integral retainer for holding the camshaft phaser on the idler shaft, and mounting openings adapted to receive fasteners that extend through the idler shaft for connection to structure, preferably the engine block, of the internal combustion engine. A radial extension is integrally connected to the center part and extends radially outwardly from an axis of the idler shaft a predefined distance. A control valve receiving part is integrally connected to radial extension and includes a control valve bore that receives the control valve. First and second passages that form parts of the first and second hydraulic medium lines extend through the center part and the radial extension to the control valve bore. A control valve including a valve spool is located in the control valve bore. An engine cover, preferably a timing gear case cover, including an opening for the control valve is provided, and the valve body is located inside the engine cover and at least a part of the control valve extends through the opening.

Preferably, a seal is provided between engine cover and the valve body housing protruding into or through the engine cover. The remainder of the variable camshaft timing system is located within the lubricated area of the engine behind the engine cover.

In one embodiment, at least part of the first pressurized hydraulic medium line and at least part of the second pressurized hydraulic medium line are formed by first and second passages in the idler shaft that are aligned with the first and second passages in the center part of the valve body. A pressurized hydraulic medium feed line comprising a feed passage is also provided in the idler shaft that is connected to an aligned feed passage in the center part that connects to a radial feed passage in the radial extension that leads to the control valve bore. The control valve is adapted to direct pressurized hydraulic medium from the pressurized hydraulic medium feed line to one of the first or second pressurized hydraulic medium lines to cause the camshaft phaser to either advance or retard the driving wheel with respect to the driven wheel.

Preferably, a radial direction and a length of the radial extension are set to locate the control valve receiving part in an accessible space at a front of the engine cover. This is advantageous to allow the control valve to be positioned in an accessible position rather than the typical centered location relative to the camshaft phaser, allowing less impact in the overall design of the front of the engine along with any accessory drives or other components in this area.

In one embodiment, the hydraulically driven phasing assembly includes chambers defined in one of the driving wheel or the driven wheel, and vanes extending from the other of the driving wheel or the driven wheel into the chambers to form an advancing chamber side and a retarding chamber side that are separated from one another. The first pressurized hydraulic medium line is in fluid communication with the advancing chambers, and the second pressurized hydraulic medium line is in fluid communication with the retarding chambers.

In one embodiment, the driven wheel is a first idler gear that is adapted to engage a crankshaft gear and the driving wheel is a second idler gear that is adapted to engage a gear connected to a camshaft. In other types of camshaft timing gear arrangements, an additional camshaft may also be driven using an additional idler gear adapted to engage the driving gear and the gear connected to that camshaft.

Preferably, the control valve includes a solenoid to move the valve spool in a first direction and a return spring to move the valve spool in a second direction, opposite to the first direction. Preferably, an axis of the control valve is oriented parallel to and offset from an axis of the idler shaft, such that the control valve is located radially spaced apart from the idler shaft in a more accessible location of the engine, for control valve serviceability.

To simplify mounting, the bolts that extend through mounting openings in the center part and in the idler shaft are configured for mounting the variable camshaft timing system to the engine block. This allows for simpler assembly and reduced part count.

Based on the arrangement provided, a drain opening from the control valve opens inside of the engine cover, allowing for a simple return path of the hydraulic medium, which is typically engine lubricating oil, to return to the oil pan.

In another aspect, a method of installing a camshaft phaser assembly on an internal combustion engine is provided. The method includes installing a hydraulically driven phasing assembly located between a driven wheel and a driving wheel on an idler shaft, installing a valve body as described above on the idler shaft using bolts that extend through the center part and the idler shaft and into an engine block, and installing a control valve in the control valve receiving bore.

The method can further provide installing the engine cover over the camshaft phaser assembly, with the engine cover including an opening for the valve body, and installing a seal between the valve body and the opening. This is the only added seal required by the camshaft phaser assembly based on the present disclosure to keep the hydraulic medium, which is preferably engine lubricating oil, within the closed system provided by the original engine design.

Preferred arrangements with one or more features of the invention are described below and in the claims.

BRIEF DESCRIPTION OF THE DRAWINGS

The foregoing Summary as well as the following Detailed Description will be best understood when read in conjunction with the appended drawings. In the drawings.

DETAILED DESCRIPTION

Figure 1:
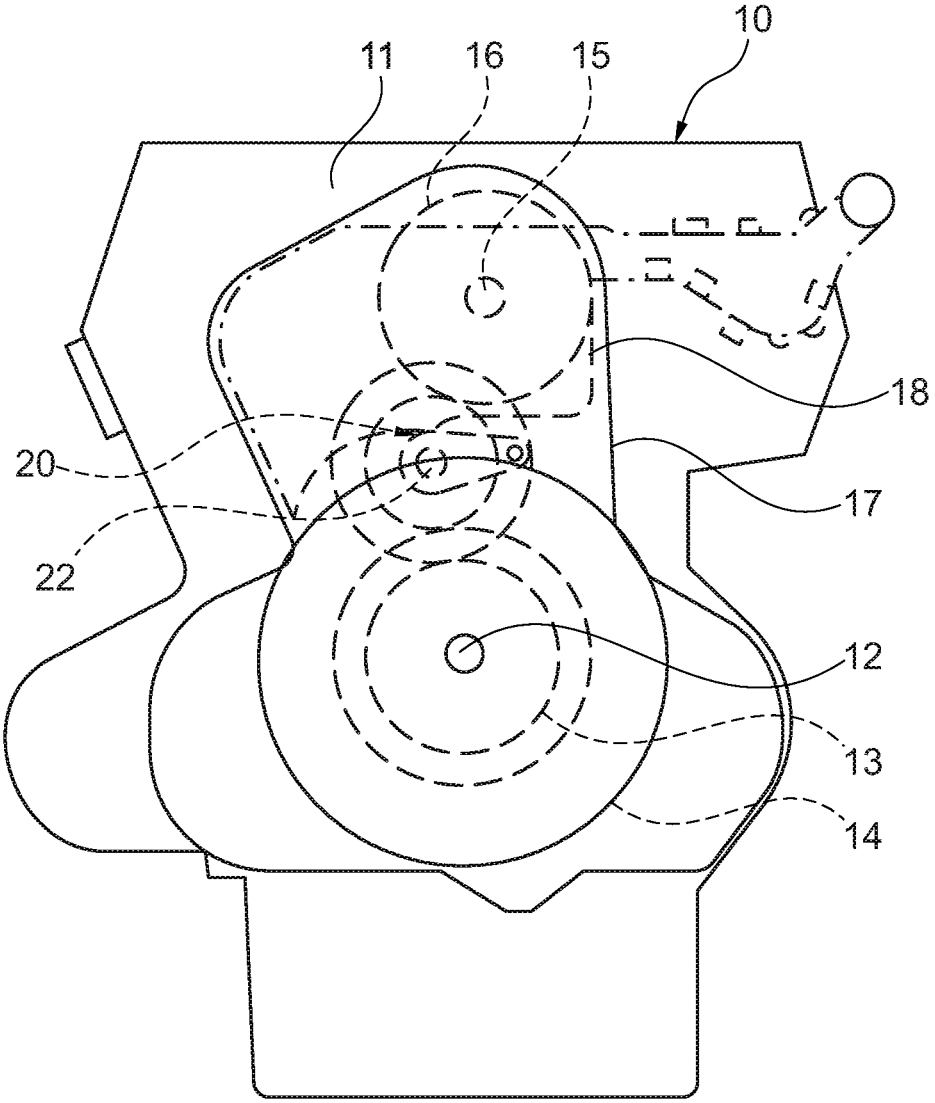
FIG. 1 is a schematic front view of an internal combustion engine showing a gear train assembly with an idler gear implemented camshaft phasing system located between the crankshaft gear and the camshaft gear.

Certain terminology is used in the following description for convenience only and is not limiting. The words "inner," "outer," "inwardly," and "outwardly" refer to directions towards and away from the parts referenced in the drawings. A reference to a list of items that are cited as "at least one of a, b, or c" (where a, b, and c represent the items being listed) means any single one of the items a, b, c or combinations thereof. The terminology includes the words specifically noted above, derivatives thereof, and words of similar import.

FIG. 1 shows an internal combustion engine 10 on which a variable camshaft timing system 20 is provided. This can be a "V" engine with a single overhead cam for each bank or an in-line engine. The engine 10 includes an engine block 11 in which the crankshaft 12 is supported in the known manner. A crankshaft gear 13, shown in broken lines, is connected to an end of the crankshaft that extends from the engine block 11 as shown, for example, in FIG. 2.

Figure 2:
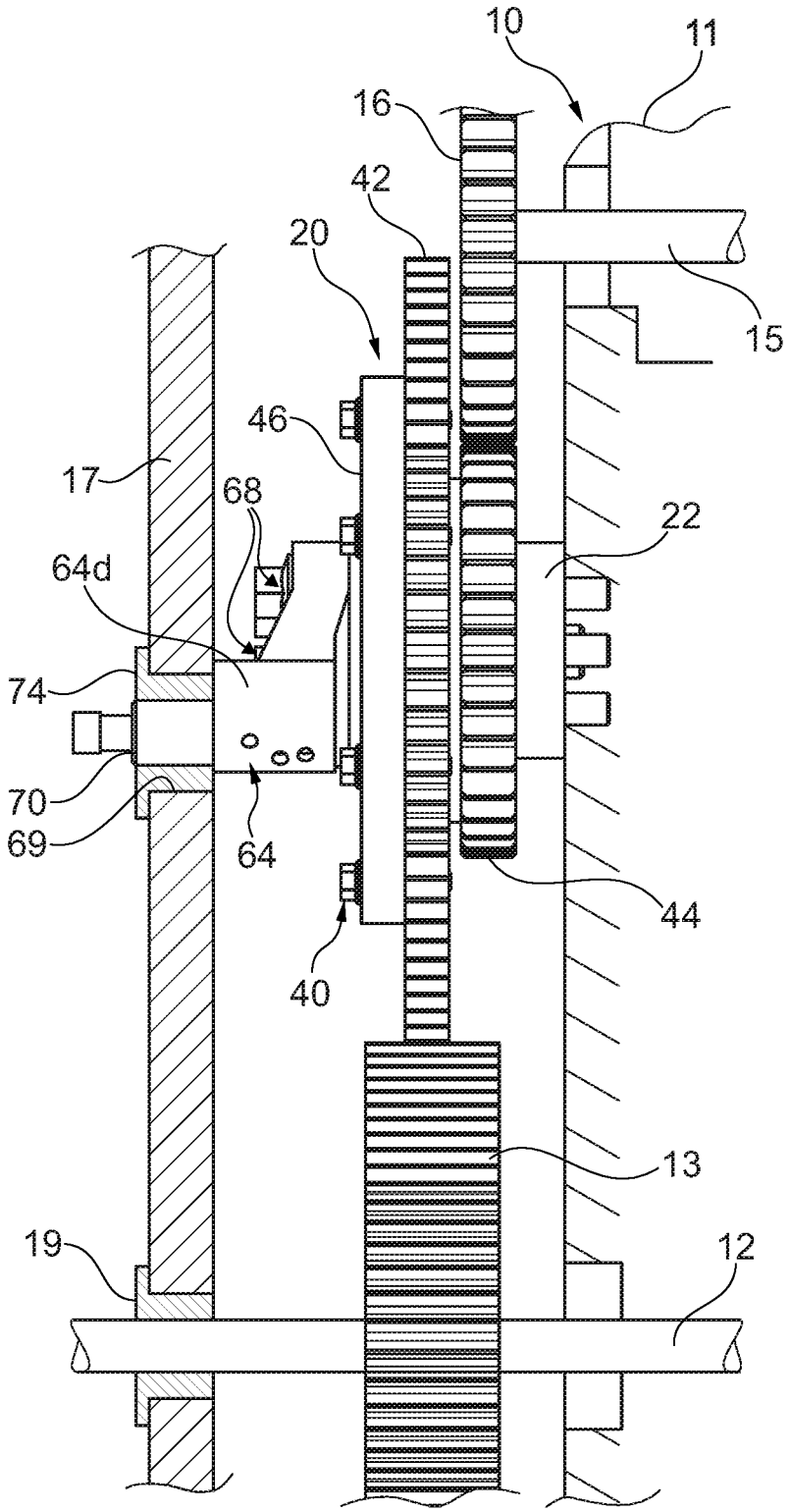
FIG. 2 is an enlarged side elevational view taken through part of the engine shown in FIG. 1 showing the position of the variable camshaft timing system.

A flywheel 14 can be mounted to the front of the crankshaft to help minimize vibration. The camshaft 15 is preferably a single overhead camshaft and includes a camshaft gear 16 connected at the front thereof. The gear train between the crankshaft 12 and the camshaft 15 is preferably located behind an engine cover 17 which allows for a lubrication of the gear train as well as prevents the ingress of outside debris and the leakage of engine oil. The engine cover 17 is shown without fasteners in FIG. 1 but would be fastened and sealed to the front of the engine block 11 in a known manner. As shown in FIG. 2, preferably a seal 19 is provided at the penetration of the crankshaft 12 through the engine cover 17. Other accessory components may be mounted to the front of the engine 10, such as an engine air box 18, shown in phantom lines in FIG. 1.

In prior known engines without variable camshaft timing, an idler gear could be located between the crankshaft gear 13 and camshaft gear 16 or alternatively, a timing chain could be provided, resulting in a fixed timing between rotation of the crankshaft and rotation of the camshaft. As shown in FIG. 1, in accordance with the present invention, the variable camshaft timing system 20 is provided which, as shown in detail in FIGS. 2-5 and 8 includes an idler shaft 22 with a bearing journal 24 on which a camshaft phaser 40 is rotatably mounted. As shown in detail FIG. 8, the idler shaft 22 preferably includes first and second oil passages 26*a*, 26*b* which are connected to feed grooves 30*a*, 30*b* for the camshaft phaser 40 as well as a feed passage 28 for a pressurized hydraulic medium, preferably engine oil, from the engine lubrication system which is delivered into the idler shaft 22 from an internal connection from the engine block 11, not shown in further detail. Mounting openings 34 are also provided for mounting the idler shaft 22 to the engine block 11.

As shown in FIGS. 2-5, 8, and 9, the camshaft phaser 40 preferably includes a driven wheel 42, which is engaged to the crankshaft gear 13, as well as a driving wheel 44, which is engaged to the camshaft gear 16. A hydraulically driven phasing assembly 46 is located between the driven wheel 42 and the driving wheel 44 and is configured for varying a relative phase of the driving wheel 44 relative to the driven wheel 42.

The camshaft phaser 40 can be provided in accordance with U.S. 2014/0102392, U.S. 2009/0260589, U.S. 2012/0111295, or U.S. 2018/0080352, all of which are incorporated herein by reference as if fully set forth. For the sake of completeness, one exemplary embodiment of the camshaft phaser 40 is shown in detail in FIG. 9 which shows the stator 48, which is connected to the driven wheel 42 and sealing cover 51 with fasteners 55, as well as the rotor 50 which is connected to the driving wheel 44 with fasteners 56. Vanes 50*a* on the rotor 50 that is connected to the driving wheel 44 extend into chambers 48*a* formed in the stator 48 in order to form an advancing chamber side 50*b* and a retarding chamber side 50*c* that are separated from one another when the rotor 50 is inserted within the stator 48. First and second pressurized hydraulic medium lines 60, 62 are connected to the hydraulically driven phasing assembly 46 through a number of passages and openings defined in the components which, for the sake of simplicity have been consistently labeled as 60 and 62 unless otherwise specifically noted. These are indicated throughout the drawings. As shown in detail in FIG. 9, the first pressurized hydraulic medium line 60 is in fluid communication with the advancing chamber 50*b* and the second pressurized hydraulic medium line 62 is in fluid communication with retarding chambers 50*c*. The chambers 50*b*, 50*c* are sealed on one side via the cover 51 and on the other side by a radial wall extending from the driven wheel 42. A plain bearing 52 is provided for supporting the camshaft phaser on the idler shaft 22. A locking mechanism with locking pin 49 and locking pin spring 53 can be provided for locking the rotor 50 in position relative to the stator 48 when the engine is shut down. Alignment pins 54 are also shown which provide for alignment of the various components during assembly. While one exemplary embodiment of the camshaft phaser 40 has been described, those skilled in the art will recognize that other changes could be made.

As shown in FIGS. 2 through 8, a valve body 64 is connected to the idler shaft 22 and retains the camshaft phaser 40 in position on the idler shaft 22. The valve body 64 includes a center part 64*a* with an integral retainer 64*b* that retains the camshaft phaser in place. Mounting openings 66 are provided in the center part 64*a* and are adapted to receive fasteners 68, preferably bolts, that extend through the idler shaft 22 and connect to the structure of the internal combustion engine 10, preferably the engine block 11. A radial extension 64*c* is integrally connected to the center part 64*a* and extends radially outwardly from an axis A of the idler shaft 22 a predefined distance. A control valve receiving part 64*d* is integrally connected to the radial extension 64*c* and includes a control valve bore 64*e* that is adapted to receive a control valve 70. The direction and length of the radial extension 64*c* are set to locate the control valve receiving part 64*d* in an accessible space at a front of the engine cover 17, for example as shown in FIG. 1 where the control valve can then be located in an accessible area outside of the regions covered by the flywheel 14 and the engine air box 18. First and second passages 60*a*, 62*a*, shown in detail in FIGS. 6 and 7, that form parts of the first and second hydraulic medium lines 60, 62 extend through the center part 64*a* and the radial extension 64*c* to the control valve bore 64*e*.

Figure 7:
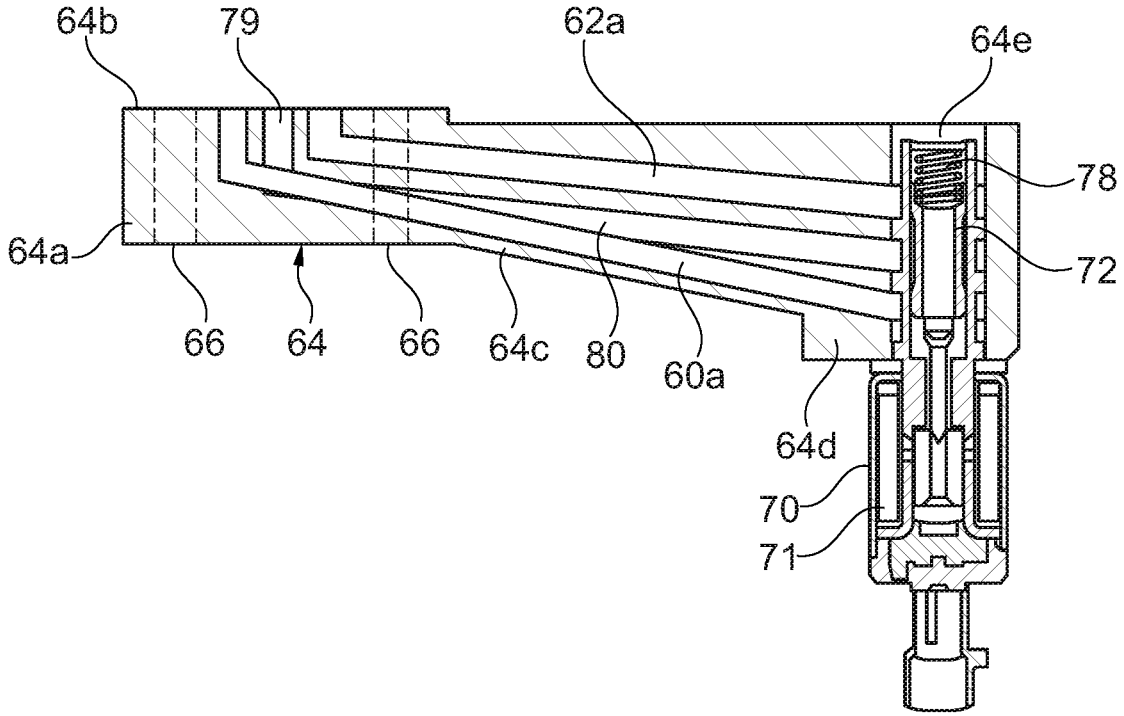
FIG. 7 is a cross-sectional view similar to FIG. 6 showing the valve body with the control valve installed.

As shown in FIGS. 2-5 and shown in detail in FIG. 7, a control valve 70 including a valve spool 72 is located in the control valve bore 64*e*. As shown in FIG. 7, the control valve 70 includes a solenoid 71 to move the valve spool 72 in a first direction and a return spring 78 to move the valve spool 72 in a second direction, opposite to the first direction. This controls the flow of pressurized hydraulic medium in a desired manner to the first and/or pressurized hydraulic medium lines 60, 62 in order to actuate the camshaft phaser 40 and either advance or retard the phasing of the driving wheel 44 relative to the driven wheel 42.

As shown in FIG. 2, the engine cover 17 includes an opening 69 for the control valve 70, and the valve body 64 is located inside the engine cover 17 and at least part of the control valve 70 extends through the opening 69 so that it is easily accessible for maintenance.

Figure 8:
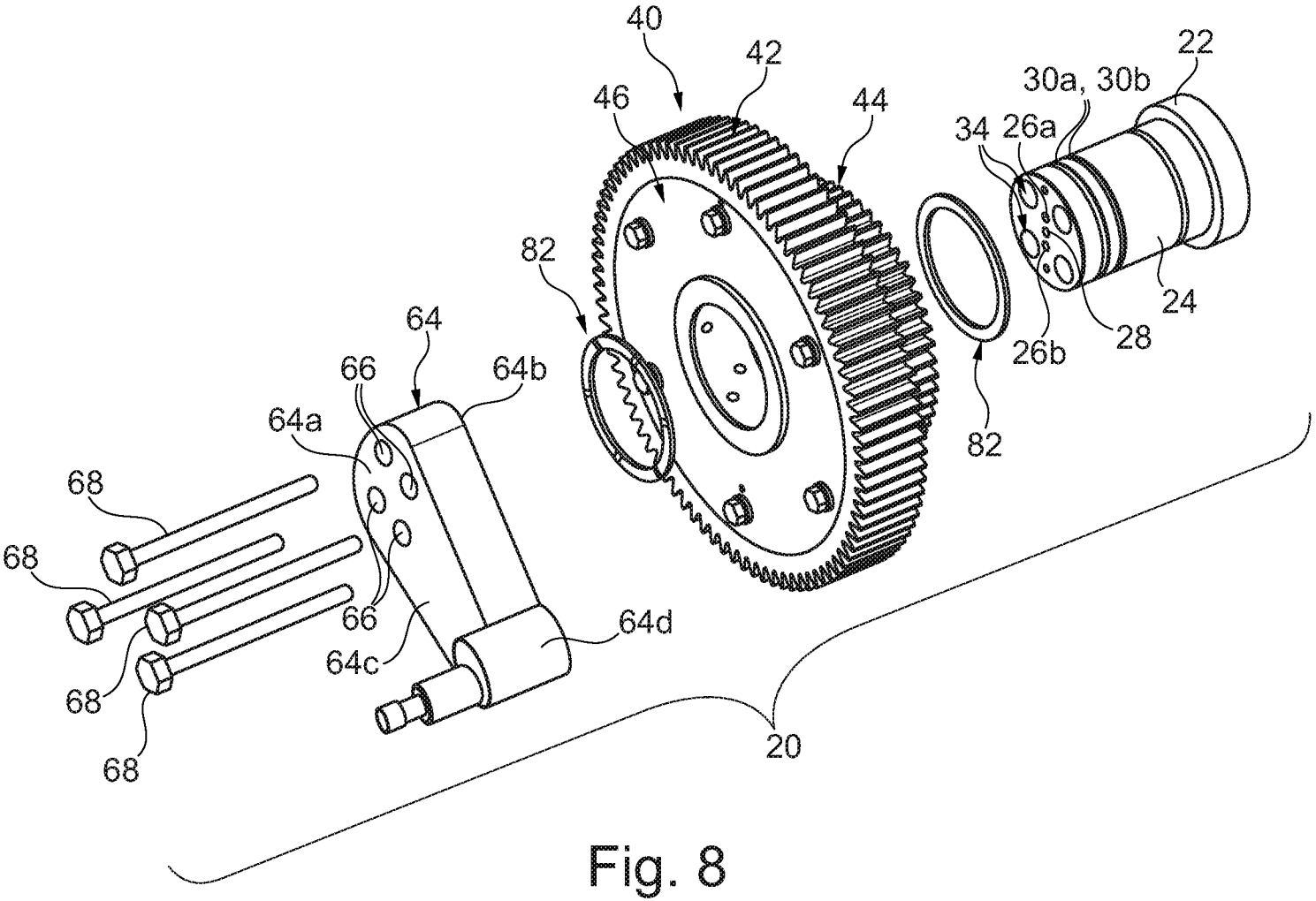
FIG. 8 is an exploded perspective view showing the variable camshaft timing system components ready for installation on an engine block.
Figure 9:
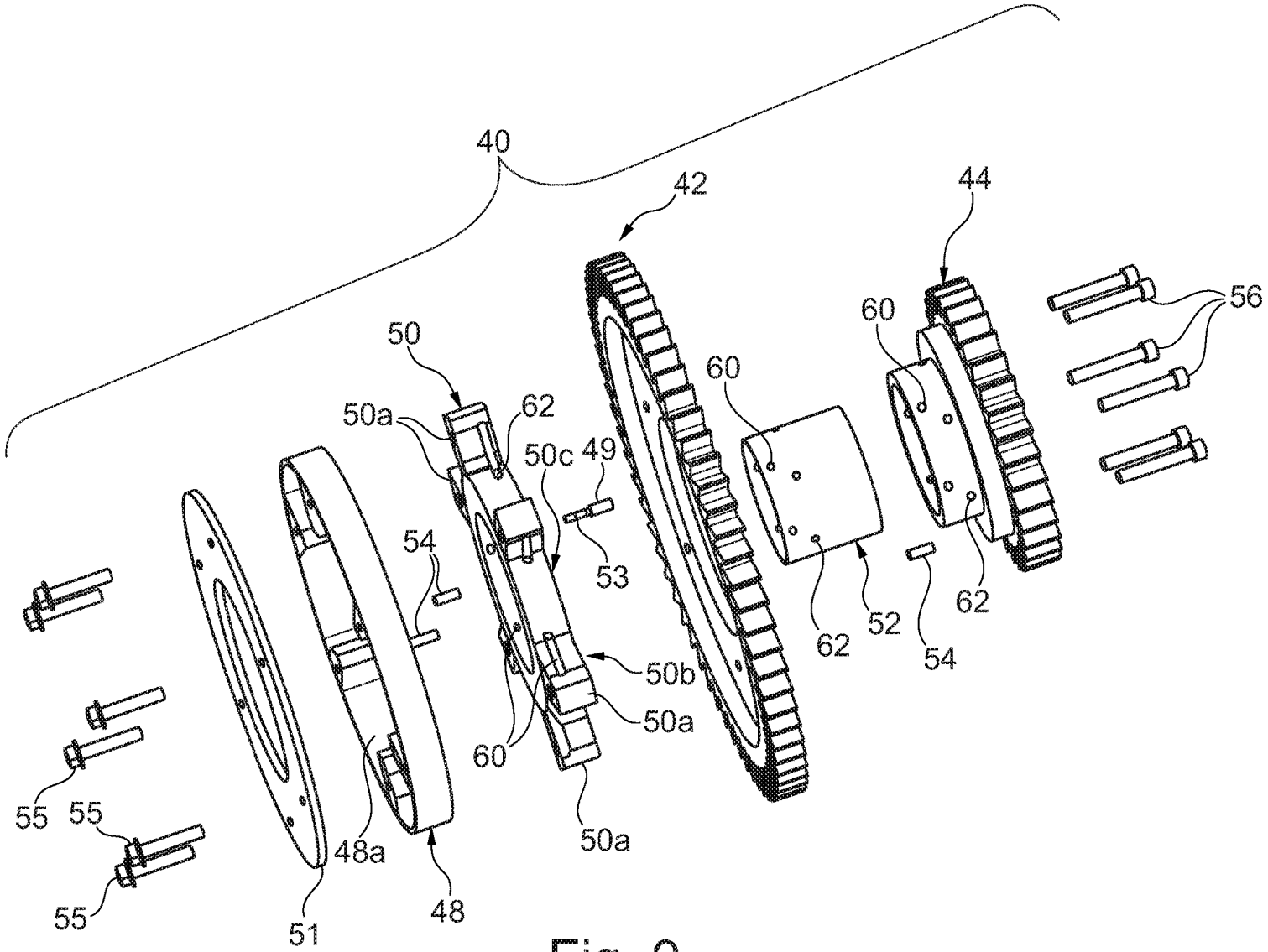
FIG. 9 is an exploded perspective view of an embodiment of a camshaft phaser that can be used in connection with the variable camshaft timing system.

As shown in connection with FIGS. 7 and 8, at least part of the first pressurized hydraulic medium line 60 and at least part of the second pressurized hydraulic medium line 62 are formed by first and second passages 26*a*, 26*b* in the idler shaft 22 that are aligned with first and second passages 60*a*, 62*a* in the center part 64*a* of the valve body 64. It is noted that for the sake of clear illustration, FIG. 7 shows the passages 60*a*, 62*a* spaced apart horizontally in the center part 64*a*. However, the openings for the passages 60*a*, 62*a* could be arranged vertically or in any other desired configuration to match the corresponding openings on the face of the idler shaft 22 where the passages 26*a* and 26*b* are shown as vertically spaced apart.

A pressurized hydraulic medium feed line is provided including the passage 28 shown in the idler shaft 22 in FIG. 8 that is connected to an aligned feed passage 79 in the center part 64*a* of the valve body 64. This connects to a radial feed passage 80 in the radial extension 64*c* that leads to the control valve bore 64*e*. Here, the control valve 70 is adapted to direct pressurized hydraulic medium from the pressurized hydraulic medium feed line to one of the first or second pressurized hydraulic medium lines 60, 62 in order to actuate the camshaft phaser 40. It can also connect one of the first or second pressurized hydraulic medium lines 60, 62 to drain during an adjustment of the camshaft phaser 40, or block the feed to both the first and second pressurized hydraulic medium lines 60, 62 to hold the phase position of the camshaft phaser 40 constant.

Figure 3:
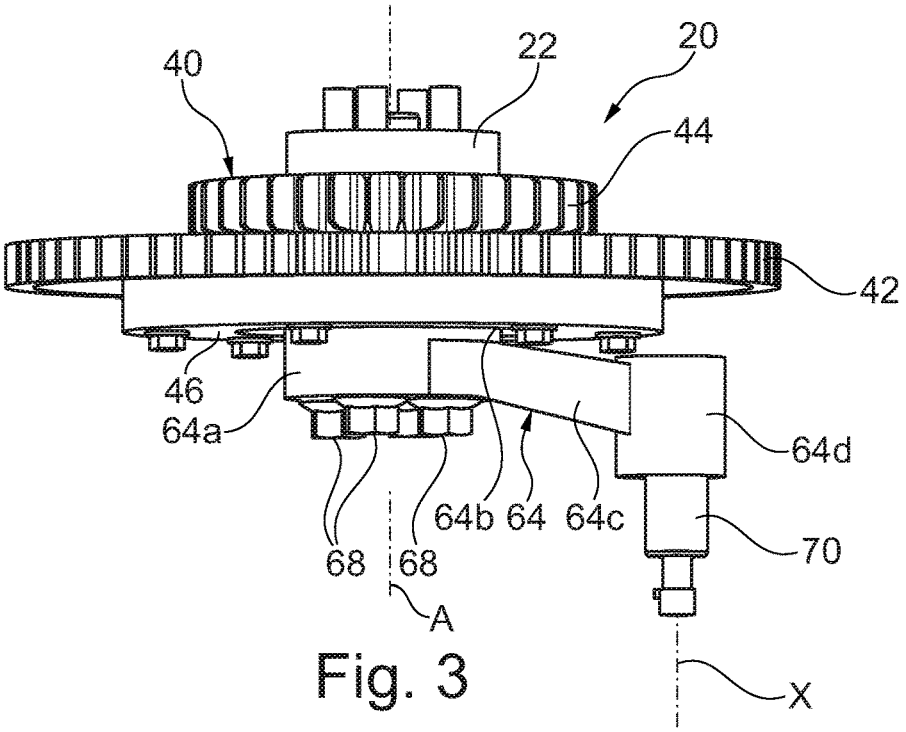
FIG. 3 is a top view of the camshaft phaser of the variable camshaft timing system.
Figure 4:
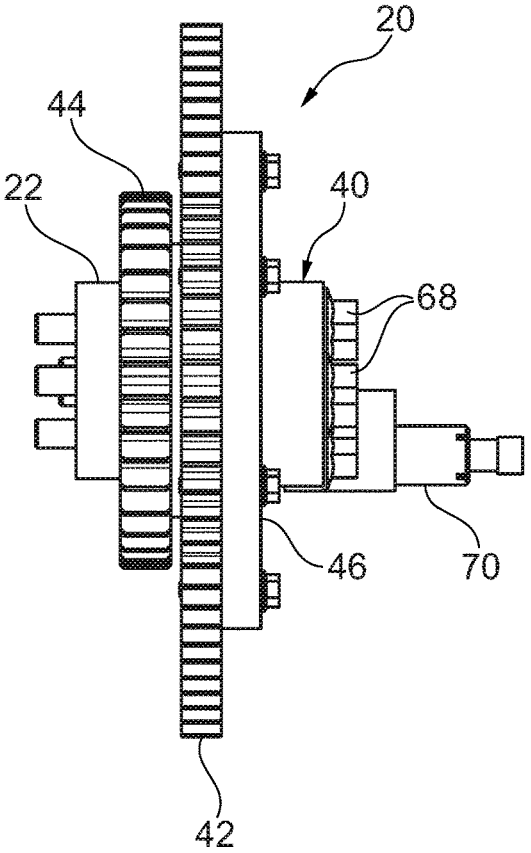
FIG. 4 is a side elevational view taken from the opposite side from FIG. 2 showing the camshaft phaser of the variable camshaft timing system.
Figure 5:
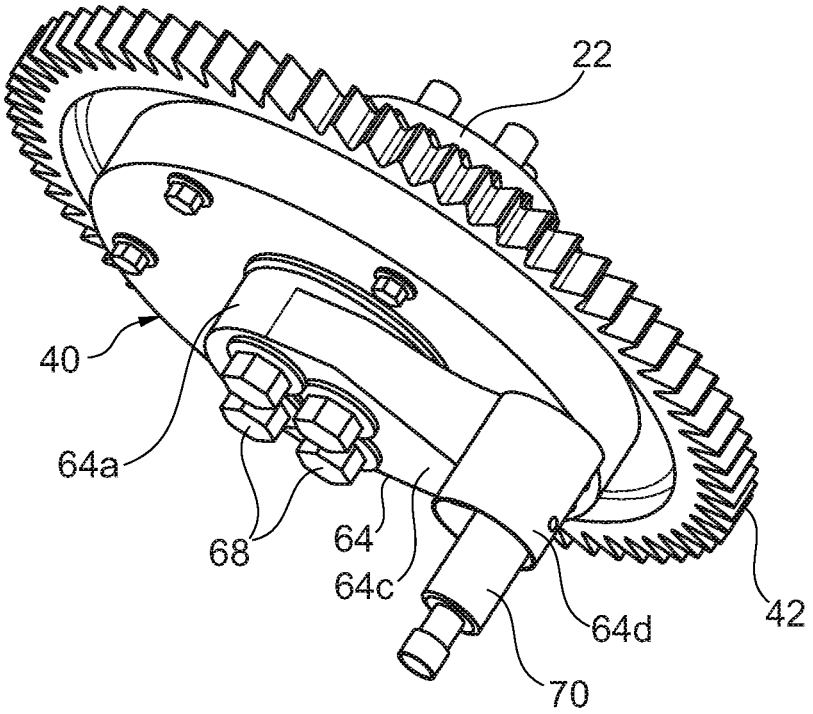
FIG. 5 is a perspective view showing the camshaft phaser of the variable camshaft timing system.
Figure 6:
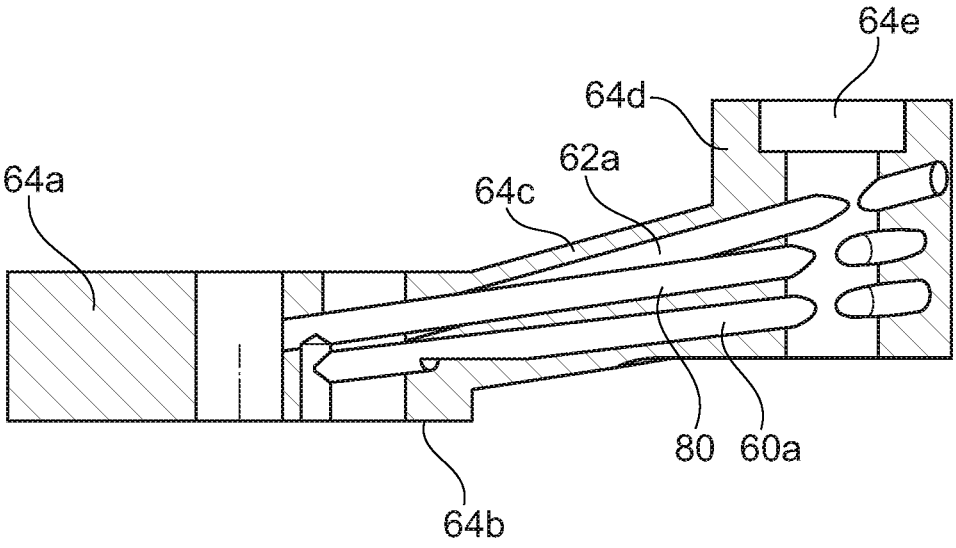
FIG. 6 is a cross-sectional view taken through the valve body used in connection with the camshaft phaser for the variable camshaft timing system which allows the control valve to be spaced apart from the mounting point of the camshaft phaser to the idler shaft.

As illustrated in FIG. 3, the control valve 70 preferably includes an axis X that is oriented parallel to an offset from the axis A of the idler shaft 22. Depending upon the configuration of the front of the engine 10, the axis X can be rotated to any convenient position in the design of the valve body 64.

Referring again to FIG. 8, according to the invention an easier assembly of the variable camshaft timing system 20 is provided in that the same fasteners 68, preferably in the form of bolts, extend through the mounting openings 66 in the valve body 64 as well as the mounting openings 34 in the idler shaft 22 in order to mount the variable camshaft timing system 20 to the engine block 11. As shown in FIG. 8, thrust washers 82 can be provided and any required positions between these components. This results in the control valve 70 being located radially spaced apart from the idler shaft 22 at a desired position to provide for easier access for maintenance with as little disruption as possible to the other component configuration of the engine 10. Further, as all of the components of the variable camshaft timing system 20 with the exception of the portion of the control valve 70 that extends through the engine cover 17, are located within the lubrication area of the internal combustion engine 10, the control valve 70 can open to drain by simply allowing fluid to be discharged through the opposite open end of the control valve bore 64*e* from the side on which the control valve 70 is installed.

A method for installing a camshaft phaser assembly 40 on an internal combustion engine as part of a variable camshaft timing system 20 is also provided. This is accomplished by installing the hydraulically driven phasing assembly 46 that is located between the driven wheel 42 and the driving wheel 44 on the idler shaft 22. The valve body 64 is then installed on the idler shaft 22 using the fasteners 68 extending through the mounting openings 66 and 34 in the valve body 64 and the idler shaft 22, respectively, that are adapted to receive the fasteners 68. These fasteners 68, preferably bolts, extend through the center part 64*a* of the valve body 64 and the idler shaft 22 and into the engine block in order to fasten the entire system 20 in position. The control valve 70 can either be previously installed or then installed in the control valve receiving bore 64*e*. The engine cover 17 can then be installed over the camshaft phaser assembly 40, with the engine cover 17 including the opening 69 for the valve body 64*d*, and a seal 74 is preferably installed between the control valve 70 and the opening 68. This provides for a simplified assembly of the variable camshaft timing system 20 with fewer potential leak points as well as easier access to the control valve 70.

Having thus described various embodiments of the present variable camshaft phaser system in detail, it will be appreciated and apparent to those skilled in the art that many changes, only a few of which are exemplified in the detailed description above, could be made in the method and variable cam phaser system according to the invention without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

LIST OF REFERENCE NUMERALS

10 internal combustion engine
11 block
12 crankshaft
13 crankshaft gear
14 flywheel
15 camshaft
16 camshaft gear
17 engine cover
18 engine air box
19 seal
20 camshaft timing system
22 idler shaft
24 bearing journal
26*a*, 26*b* oil passages
28 feed passage
30*a*, 30*b* feed grooves
34 mounting openings
40 camshaft phaser
42 driven wheel
44 driving wheel
46 phasing assembly
48 stator
48*a* chambers
49 locking pin
50 rotor
50*a* vanes
50*b* advancing chamber side
50*c* retarding chamber side
51 sealing cover
52 plain bearing
53 locking pin spring
54 alignment pin
60, 62 hydraulic medium lines
60*a*, 62*a* first and second passages
64 valve body
64*a* center part
64*b* integral retainer
64*c* radial extension
64*d* receiving part
64*e* control valve bore
66 mounting openings
68 fasteners
69 opening
70 control valve
71 solenoid
72 valve spool
74 seal
78 return spring
79 feed passage
80 radial feed passage
82 thrust washers

What is claimed is:

1. A variable camshaft timing system for an internal combustion engine, the variable camshaft timing system comprising:
- an idler shaft with a bearing journal;
- a camshaft phaser rotatably mounted on the bearing journal, including a driven wheel, a driving wheel, and a hydraulically driven phasing assembly configured for varying a relative phase of the driving wheel with respect to the driven wheel;
- first and second pressurized hydraulic medium lines connected to the hydraulically driven phasing assembly;
- a valve body connected to the idler shaft, the valve body including:
  - a center part with an integral retainer configured to hold the camshaft phaser on the idler shaft, and mounting openings adapted to receive fasteners that extend through the idler shaft, the fasteners configured for connection to structure of the internal combustion engine,
  - a radial extension integrally connected to the center part and extending radially outwardly from an axis of the idler shaft a predefined distance,
  - a control valve receiving part integrally connected to the radial extension and including a control valve bore that is adapted to receive a control valve, and
  - first and second passages that respectively form parts of the first and second hydraulic medium lines extend through the center part and the radial extension to the control valve bore;
- the control valve including a valve spool located in the control valve bore, the control valve adapted to be received within an opening of an engine cover; and
- the valve body is configured to be located inside the engine cover and at least a part of the control valve is configured to extend through the opening of the engine cover.

2. The variable camshaft timing system of claim 1, further comprising a seal between the engine cover and the valve body.

3. The variable camshaft timing system of claim 1, wherein at least part of the first pressurized hydraulic medium line is formed by a first passage in the idler shaft that is aligned with the first passage in the center part of the valve body, and at least part of the second pressurized hydraulic medium line is formed by a second passage in the idler shaft that is aligned with the second passage in the center part of the valve body.

4. The variable camshaft timing system of claim 3, further comprising a pressurized hydraulic medium feed line comprising a feed passage in the idler shaft that is connected to an aligned feed passage in the center part, that connects to a radial feed passage in the radial extension that leads to the control valve bore, the control valve being adapted to direct pressurized hydraulic medium from the pressurized hydraulic medium feed line to one of the first or second pressurized hydraulic medium lines so as to cause the camshaft phaser to either advance or retard the driven wheel with respect to the driving wheel.

5. The variable camshaft timing system of claim 1, wherein a direction and a length of the radial extension are set so as to locate the control valve receiving part at a front of the engine cover.

6. The variable camshaft timing system of claim 1, wherein the hydraulically driven phasing assembly includes:
- chambers defined in one of the driving wheel or the driven wheel, vanes extending from a remaining one of the driving wheel or the driven wheel into the chambers to form respective advancing chamber sides and retarding chamber sides that are separated from one another, the first pressurized hydraulic medium line is in fluid communication with the advancing chamber sides, and the second pressurized hydraulic medium line is in fluid communication with the retarding chamber sides.

7. The variable camshaft timing system of claim 1, wherein the driving wheel is a first idler gear that is adapted to engage a crankshaft gear and the driven wheel is a second idler gear that is adapted to engage a gear connected to a camshaft.

8. The variable camshaft timing system of claim 1, wherein the control valve includes a solenoid configured to move the valve spool in a first direction and a return spring configured to move the valve spool in a second direction, opposite to the first direction.

9. The variable camshaft timing system of claim 8, wherein an axis of the control valve is oriented parallel to and offset from an axis of the idler shaft.

10. The variable camshaft timing system of claim 1, further comprising bolts that extend through the mounting openings in the center part and the opening in the idler shaft that are configured for mounting the variable camshaft timing system to an engine block.

11. The variable camshaft timing system of claim 1, wherein the control valve is located radially spaced apart from the idler shaft.

12. The variable camshaft timing system of claim 1, wherein a drain opening from the control valve opens inside of the engine cover.

13. A method of installing a camshaft phaser assembly on an internal combustion engine, the method comprising:

installing a hydraulically driven phasing assembly located between a driving wheel and a driven wheel on an idler shaft;

installing a valve body on the idler shaft using bolts, the valve body including a center part with an integral retainer configured to hold the camshaft phaser on the idler shaft and fastener openings adapted to receive fasteners that extend through the idler shaft configured to connect to structure of the internal combustion engine, a radial extension integrally connected to the center part and extending radially outwardly from an axis of a bearing journal a predefined distance, a control valve receiving part integrally connected to the radial extension and including a control valve bore that receives a control valve, and first and second passages that respectively form parts of first and second hydraulic medium lines extend through the center part and the radial extension to the control valve bore, wherein the bolts extend through the center part and the idler shaft and into an engine block; and installing the control valve in the control valve receiving bore.

14. The method of claim 13, further comprising installing an engine cover over the camshaft phaser assembly, the engine cover including an opening for the valve body that receives the control valve, and installing a seal between the valve body and the opening of the engine cover.

* * * * *